United States Patent [19]

Hobbs

[11] 4,404,979

[45] Sep. 20, 1983

[54] APPARATUS FOR CLEANING THE BORE OF A FLINTLOCK MUZZLELOADING RIFLE

[76] Inventor: Larry R. Hobbs, 611 S. Amy La., Idaho Falls, Id. 83401

[21] Appl. No.: 300,647

[22] Filed: Sep. 9, 1981

[51] Int. Cl.[3] ..... B08B 9/00

[52] U.S. Cl. ..... 134/166 C; 42/1 BC

[58] Field of Search ..... 134/10, 22.11, 104, 134/166 C, 167 C; 42/1 BC, 51

[56] References Cited

U.S. PATENT DOCUMENTS 4,212,414 7/1980 Beyens ..... 134/166 C X

FOREIGN PATENT DOCUMENTS 4064 of 1910 United Kingdom ..... 134/2

615350 1/1949 United Kingdom ..... 134/167 C

*Primary Examiner*—Robert L. Bleutge

*Attorney, Agent, or Firm*—Fitch, Even, Tabin & Flannery

[57] ABSTRACT

Apparatus for cleaning the longitudinal bore in the barrel of a flintlock muzzleloading type rifle without removing the barrel from the stock and wherein the barrel has a touchhole formed in its breach end normally covered by the lock assembly. The apparatus includes a tubular drain member having a radial flange on which is mounted an annular seal adapted for sealing engagement with the barrel circumferentially of the touchhole opening after removal of the lock assembly. A mounting clip attached to the drain member facilitates releasable mounting of the apparatus on the barrel. In cleaning the bore, the lock assembly is removed from the stock to expose the touchhole, the drain member is mounted on the rifle by the mounting clip so as to seal about the touchhole opening, and a flushing liquid or solvent is poured down the barrel bore and discharged through the touchhole and drain member to a receptacle.

6 Claims, 6 Drawing Figures

10
12a
2.
24
12b
20
22
26
28
42a
14
14a
36
38
42b
2.
14b 74
50
52
56
12c
32
12
18
16
76b
70
34
14

74
4.
74a 54
62
70
74b
64
52
56
76b
4.

74
74a
5.
62
64
54
52
5.
76b
78

80
76
54
62
56
70
70a
58b
58
76a
58a
64
76c
52
70b 16
12a
82

12
28
44a
12c
46
74b
70
64
74
74a
44b
38
66
14c

APPARATUS FOR CLEANING THE BORE OF A FLINTLOCK MUZZLELOADING RIFLE

BACKGROUND OF THE INVENTION

The present invention relates generally to flintlock muzzleloading rifles, and more particularly to a novel method and apparatus for cleaning the longitudinal bore of a flintlock muzzleloading rifle.

The history of flintlock muzzleloading rifles indicates that they originated in the middle 1600's and were widely used for the next two centuries without substantial changes in their general features. Their collection and use by contemporary hobbiests for both competitive shooting exhibitions and display has sustained interest in preserving such rifles. In the use of a flintlock muzzleloading rifle, the cock, which generally corresponds to the hammer as employed in percussion-lock rifles, has a pair of jaws for holding a flint which is caused to strike the frizzen throwing it back and dropping a shower of sparks into the underlying pan which contains a priming powder. The ignited primer acts through a passage in the barrel, termed the touchhole, to ignite the primary charge and propel projectile or "shot" previously inserted into the muzzle end of the barrel bore. After numerous shots have been fired, a residue or fouling is built up on the surface of the bore which requires cleaning to prevent possible malfunction to the rifle. This problem is particularly prevalent when using black powder as the primary charge.

The conventional method for cleaning the barrel bore of a flintlock muzzleloading rifle involves flushing of the bore with warm water to remove the fouling buildup. The water and flushed fouling is discharged from the touchhole in the breech end of the barrel. In this process, the barrel must be removed from the rifle stock in order to prevent the stock from becoming soaked and thereby discolored and damaged. Removal of the barrel from the stock does not present a particularly significant problem when the stock extends approximately one-half or less of the length of the barrel. However, for muzzleloading rifles having long slender stocks which extend substantially the full length of the barrel, removal of the barrel subjects the fragile stock to possible damage and/or breakage. In addition, removal of the barrel from the stock is time consuming. As a consequence, it is highly desirable that the barrel and stock of a flintlok muzzleloading rifle remain in assembled relation during cleaning. Thus, a need exists for an improved method and apparatus for cleaning the bore of a flintlock muzzleloading rifle which do not require removal of the barrel from the stock and which are relatively simple in construction and procedure.

BRIEF DESCRIPTION OF THE INVENTION

In accordance with the present invention, a method and apparatus for cleaning the bore of a flintlock muzzleloading rifle are provided which require only the removal of the lock assembly from the stock so as to expose the touchhole in the barrel. The apparatus includes a generally tubular drain member having an annular flange on one end on which is mounted an annular sealing member adapted to engage the barrel circumferentially of the touchhole. A generally U-shaped mounting clip is attached to the drain member and facilitates mounting of the drain member on the rifle with the sealing member disposed peripherally of the touchhole opening. A drain tube affixed at one end of the drain member has its opposite end adapted for discharge into a receptacle.

In accordance with the method of the invention, the lock assembly of the flintlock muzzleloading rifle is first removed to expose the touchhole, and the drain member and associated sealing element are releasably affixed to the barrel in sealing relation peripherally of the touchhole. The rifle is then placed in an upstanding position with the bore pointing upwardly and warm water or black powder solvent is poured down the bore. The water or solvent and flushed or dissolved carbon fouling are discharged through the touchhole and sealed drain member to the receptacle without spillage on the stock.

Accordingly, a general object of the present invention is to provide a novel method and apparatus for cleaning the bore in the barrel of a flintlock muzzleloading rifle without removal of or damage to the associated stock.

A more particular object of the present invention is to provide a novel method and apparatus for cleaning the longitudinal bore of a flintlock muzzleloading type rifle which require removal of only the lock assembly to expose the touchhole in the barrel, the apparatus including a drain member defining a fluid flow passage therethrough and having an annular sealing member adapted for sealing engagement with the barrel peripherally of the touchhole opening when the drain member is mounted on the rifle by means of a mounting clip. Warm water or a solvent may then be poured down the bore of the barrel and discharged from the touchhole to a suitable receptacle.

Further objects, features and advantages of the present invention will become apparent from the following detailed decription of the invention when taken in conjunction with the accompanying drawing wherein like reference numerals designate like elements throughout the several views.

DESCRIPTION OF THE PREFERRED EMBODIMENT

Figure 1:
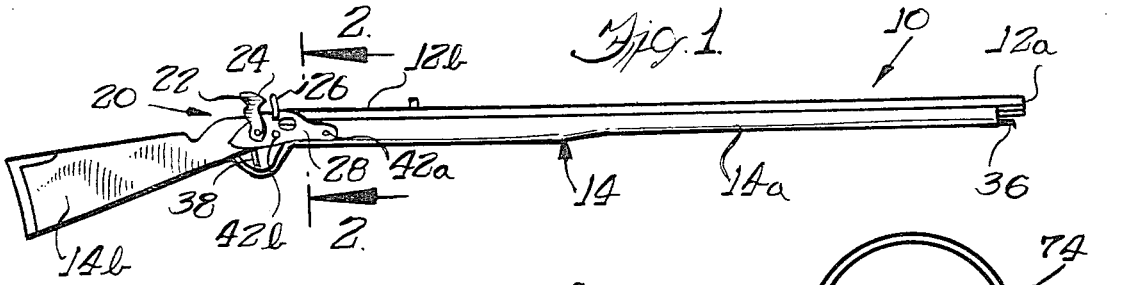
FIG. 1 is a side elevational view of a flintlock muzzleloading rifle of the type with which the present invention finds application.
Figure 2:
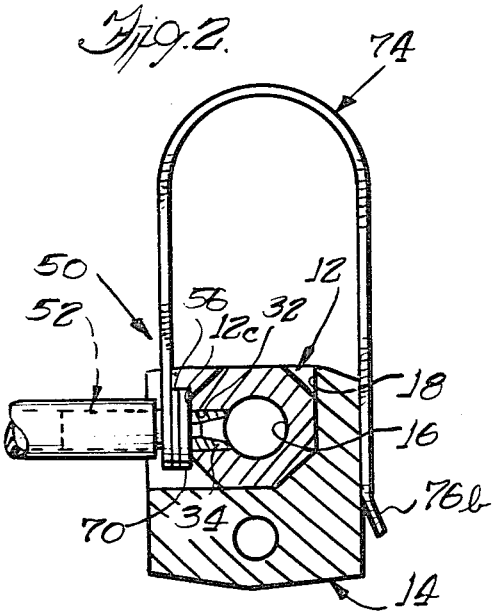
FIG. 2 is a transverse sectional view of the rifle of FIG. 1, taken substantially along line 2—2 of FIG. 1, but showing apparatus in accordance with the present invention mounted on the barrel preparatory to cleaning the barrel bore.

Referring now to the drawing, and in particular to FIG. 1, a flintlock muzzleloading type rifle of the type with which the present invention finds application is indicated generally at 10. The flintlock muzzleloading rifle 10 is of conventional known design and may take any one of a number of known forms. In the illustrated embodiment, the rifle 10 includes an elongated barrel, indicated generally at 12, and a stock, indicated generally at 14. The barrel 12 has a hexagonal external surface configuration and defines a longitudinal bore 16 which extends from a muzzle or discharge end 12*a* of the barrel rearwardly to a breech end 12*b*. The barrel 12 is releasably affixed to an elongated portion 14*a* of the stock 14 such as by being mounted within a suitably configured groove 18 formed along the upper edge surface of the stock portion 14*a*, as shown in FIG. 2.

The stock includes a shoulder abutting portion 14*b* and has a lock assembly, indicated generally at 20, of known design mounted on the stock adjacent the breech end 12*b* of the barrel. Briefly, the lock assembly 20 includes a cock 22 adapted to hold a flint 24. A frizzen and pancover member 26 is pivotally mounted on a mounting plate 28 of the lock assembly in a manner to enable raising of the frizzen for placing a primer charge within a pan or recess (not shown) formed in the lock assembly in communication with a touchhole such as indicated at 32 in FIG. 2. The touchhole 32 intersects one of the longitudinally extending flat surfaces of the hexagonal shaped barrel, such as 12*c*, and also intersects the longitudinal bore 16. The touchhole 32 may have an annular touchhole liner 34 inserted therein although such liners are not used in all flintlock muzzleloading type rifles.

The operation of the flintlock muzzleloading rifle 12 as thus far described is conventional. Briefly, a primary charge is poured down the barrel from the muzzle end followed by insertion of paper wadding and a ball type projectile which are rammed "home" by a ramrod such as indicated at 36 and which may be carried in the elongated end 14*a* of the stock as is known. The cock 22 is then moved to a position enabling raising of the frizzen and pan cover 26 to expose the pan and facilitate insertion of a primer powder into the pan. The frizzen is then again lowered to cover the pan and primer. At this point, the rifle is loaded. Shooting is effected by fully cocking the cock 22 and releasing it through the trigger 38 whereupon the flint 24 strikes and slightly raises the frizzen 26 causing a shower of sparks to drop into the pan and ignite the primer which, in turn, causes ignition of the primary charge through the touchhole 32 to project the shot or projectile from the rifle bore. The primary charge conventionally includes black powder which, after numerous shots, results in a buildup of residue or fouling on the interior surface of the bore 16.

Figure 6:
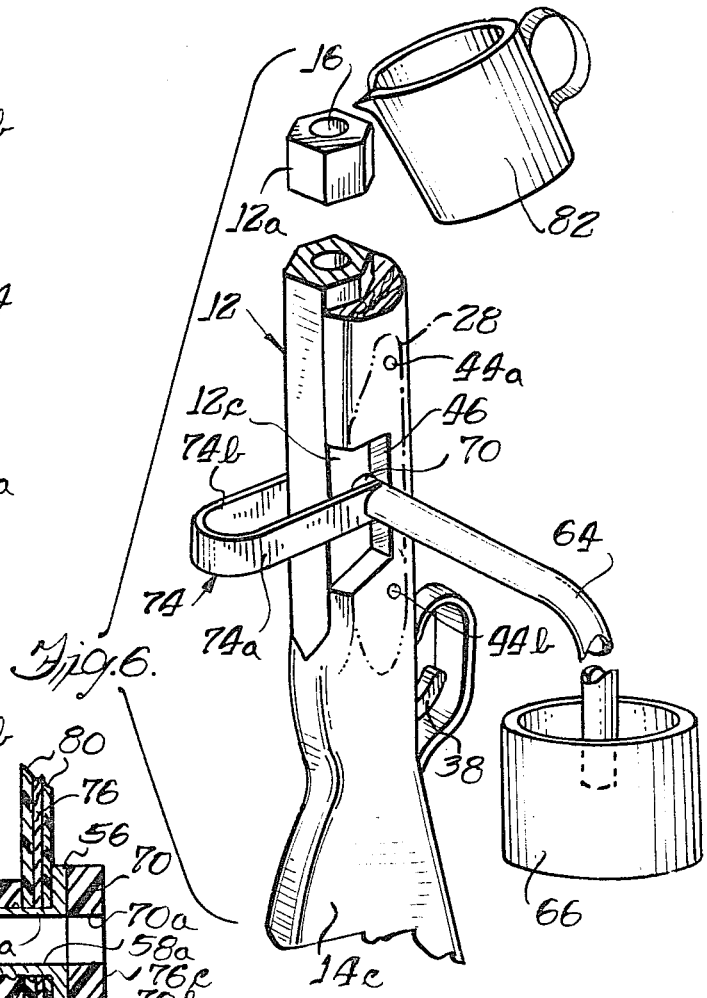
FIG. 6 is a fragmentary and foreshortened perspective view illustrating cleaning of the bore of a flintlock muzzleloading rifle in accordance with the method and apparatus of the present invention.

The lock assembly 20 is secured to the stock 14 in a conventional manner, such as by means of mounting bolts 42*a* and 42*b* which extend through suitable openings in the mounting plate 28 and through corresponding bores 44*a* and 44*b* formed in the stock 14 as shown in FIG. 6. The stock is mortised, as shown at 46 in FIG. 6, to accommodate the various operating parts of the lock assembly. In this manner, the lock assembly 20 may be removed from the stock and barrel of the rifle to expose the touchhole for cleaning purposes.

In accordance with the present invention, apparatus, indicated generally at 50, is provided for use in cleaning the longitudinal bore 16 of the barrel 12 while the barrel is mounted on the stock 14 but with the lock assembly 20 removed to expose the touchhole 32. The apparatus 50, which may be termed a touchhole sealer, is adapted to be releasably mounted on the rifle 12 with the lock assembly 20 removed so as to seal about the full periphery of the exposed touchhole 32 and facilitate cleaning of the bore by pouring warm water or a solvent down the bore of the barrel 12, the liquid being discharged through the touchhole without contacting the stock, particularly in the area of the lock mortise area 46.

The apparatus 50 includes a drain member, indicated generally at 52, which has a generally cylindrical tubular portion 54 having an annular flange 56 formed integral with or suitably affixed to one end thereof such that the flange is concentric with and normal to the axis of the tubular portion 54. The tubular portion 54, which may be made of a suitable metallic or non-metallic material, defines a fluid flow passage 58 therethrough having an entry end 58*a* adjacent the annular flange 56 and having an opposite discharge end 58*b*.

Figure 3:
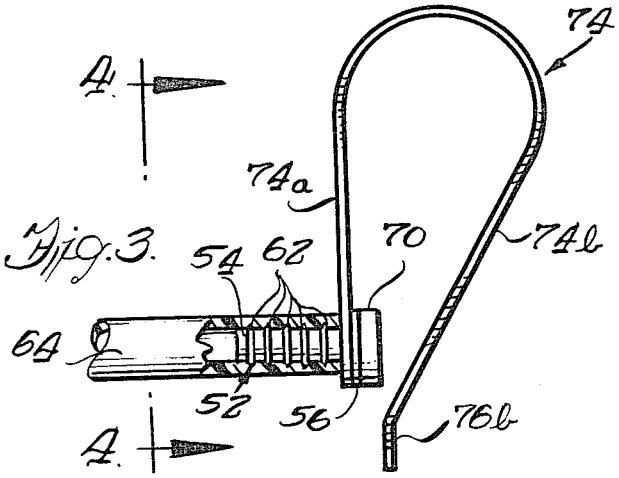
FIG. 3 is a fragmentary front elevational view of the apparatus illustrated in FIG. 2 but with portions broken away for clarity.
Figure 4:
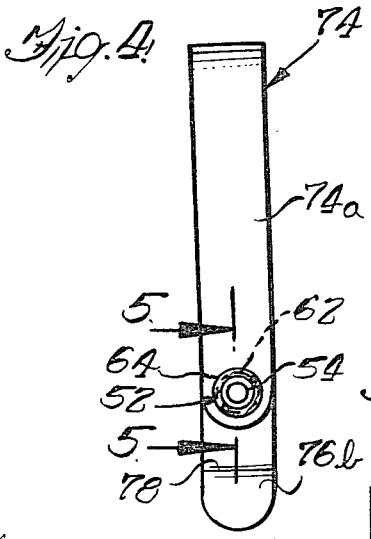
FIG. 4 is a sectional view taken substantially along the line 4—4 of FIG. 3, looking in the direction of the arrows.
Figure 5:
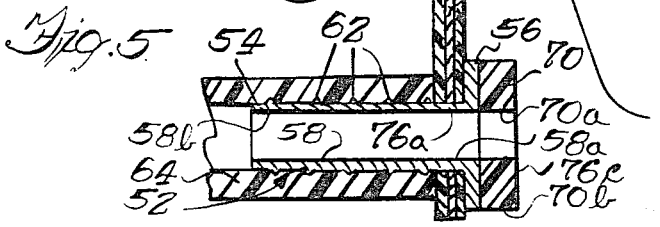
FIG. 5 is a fragmentary longitudinal sectional view taken substantially along line 5—5 of FIG. 4 but on an enlarged scale.

A plurality of substantially identical external annular ribs 62 are preferably formed along the outer peripheral surface of the tubular member 54 in equally spaced relation thereon to facilitate retention of a flexible drain tube 64 which is inserted over the tubular portion 54 of drain member 52 as illustrated in FIGS. 3 and 5. The annular ribs 62 are preferably of generally triangular transverse cross section with the bases of the triangular ribs being formed integral with the tubular portion 54 of the drain member 52. The drain tube 64 is preferably made of a clear vinyl plastic and is of a suitable length to enable the end opposite the drain member 52 to be inserted into a suitable fluid retaining receptacle such as indicated at 66 in FIG. 5.

Sealing means in the form of an annular seal or gasket 70 is mounted on the flange 56 of the drain member 52 in coaxial relation with the fluid entry end 52*a* thereof. The annular seal member 70 may be made of neoprene having a durometer hardness of approximately 40–60 and is affixed to the flange 56 by suitable means such as a commercial bonding material. The seal member 70 has a central opening 70*a* of substantially equal diameter to the diameter of the fluid entry end 58*a* of the tubular member 54 and has an outer peripheral surface 70*b* of substantially equal diameter to the outer diameter of the annular flange 56. The sealing member 70 has an external annular sealing surface 70*c* adapted for sealing engagement with the barrel surface 12*c* so as to extend about the full periphery of the exposed end of touchhole 32 with the central opening 70*a* in fluid communication with the touchhole.

Mounting means in the form of a mounting clip, indicated generally at 74, is attached to drain member 52 for releasably mounting the drain member on the barrel 12 and associated stock 14 with the sealing member 70 disposed peripherally of the touchhole 32. In the illustrated embodiment, the mounting clip 74 has a generally U-shaped configuration defining leg portions 74*a* and 74*b*. The mounting clip includes a U-shaped metallic clip member 76 having a circular opening 76*a* in the end corresponding to leg 74*a*. The opening 76*a* is sized to facilitate mounting of the clip member onto the tubular portion 54 of drain member 52 as illustrated in FIG. 5. The portion of the metallic clip 76 corresponding to leg 74*b* has its free end bent outwardly to form a tab 76*b* bent about a generally transverse bend line 78. In its relaxed position, as shown in FIG. 3, the leg portions of the mounting clip 74 are disposed in converging relation requiring manual spreading for mounting on the rifle 10. The tab 76*b* provides a finger tab facilitating spreading of the mounting clip during assembly onto the rifle. The metallic clip 76 preferably has a rubber or vinyl coating 80 formed thereon to prevent marring of the rifle stock when the apparatus 50 is mounted thereon.

In cleaning the bore 16 of the flintlock muzzle-loading rifle 10 in accordance with the present invention, the lock assembly 20 is first removed from the stock 14 by removing the bolts 42*a,b* as aforedescribed so as to expose the touchhole 32. The sealer apparatus 50 is then assembled onto the stock and barrel of the rifle by spreading the legs 74*a,b* of the mounting clip member 74 and positioning the sealing member 70 against the barrel surface 12*c* peripherally of the touchhole opening 32, as shown in FIGS. 2 and 6. Preferably, any powder residue is wiped from the barrel in the area of the touchhole 32 with a piece of cleaning cloth damp with black powder solvent and the area is allowed to dry prior to assembling the sealer apparatus 50 onto the rifle. The end of the drain tube 64 opposite the drain member 52 is inserted into a suitable liquid retaining receptacle 66, the length of the drain tube being selected as necessary for this purpose.

With the sealer apparatus 50 mounted on the rifle 12 as aforedescribed, the rifle is placed in a upstanding position with the bore 16 facing generally upwardly, such as by placing the shoulder end 14*b* of the stock on a floor surface and holding the rifle in an upstanding position. A flushing liquid, such as warm water, or a liquid black powder solvent is then poured from a suitable container, such as indicated at 82 in FIG. 6, into the upper muzzle end of the bore 16 such that the flushing liquid or solvent passes down the barrel and removes the fouling whereafter the liquid is discharged through the touchhole 32 and sealed drain member 52 through the drain tube 64 to the receptacle 66. In this manner, cleaning of the bore 16 is effected without spillage of the flushing liquid or cleaning solvent onto the stock 12, particularly in the mortise area 46 of the stock. Both the appearance and life of the rifle 10 are greatly enhanced by the use of the sealer apparatus 50 in accordance with the invention.

While a preferred embodiment of the present invention has been illustrated and described, it will be understood that changes and modifications may be made therein without departing from the invention in its broader aspects. Various features of the invention are defined in the following claims.

What is claimed is:

1. Apparatus for use in cleaning the longitudinal bore in a barrel of a flintlock muzzleloading type rifle wherein the barrel is mounted on a stock and has an exposed touchhole opening communicating with the longitudinal bore, said apparatus comprising;

a drain member having a flow passage therethrough intersecting at least one end and defining a fluid entry opening at said one end, seal means mounted on said drain member adjacent said one end and having an annular sealing surface adapted for sealing engagement with said barrel peripherally of said exposed touchhole opening, said seal means having a flow passage communicating with said touchhole and with said flow passage in said drain member, and mounting means attached to said drain member and enabling releasable mounting of said drain member and sealing means on said barrel and stock with said annular sealing surface engaging said barrel peripherally of said touchhole opening so that cleaning fluid introduced into the muzzle end of the longitudinal bore is discharged through said touchhole and through said drain member.

2. Apparatus as defined in claim 1 including a flexible drain having one end mounted on said drain member and having an opposite end adapted for remote placement in a fluid receptacle.

3. Apparatus as defined in claim 2 wherein said tubular portion of said drain member has a plurality of annular ribs formed on its external surface for retaining cooperation with said drain tube.

4. Apparatus as defined in claim 1 wherein said drain member includes a generally tubular portion having an annular flange at one end thereof, said seal means comprising an annular seal member secured to said flange member in concentric relation to said fluid flow passage.

5. Apparatus as defined in claim 1 wherein said mounting means comprises a generally U-shaped mounting clip having one end attached to said drain member and having a free opposite end facilitating releasable mounting of said apparatus on said barrel and stock with said sealing surface disposed circumferentially of said touchhole opening.

6. Apparatus as defined in claim 5 wherein said mounting clip includes a metallic mounting clip member having a nonmetallic coating formed thereon.

* * * * *

UNITED STATES PATENT AND TRADEMARK OFFICE

CERTIFICATE OF CORRECTION

PATENT NO. : 4,404,979

DATED : September 20, 1983

INVENTOR(S) : Larry R. Hobbs

It is certified that error appears in the above-identified patent and that said Letters Patent is hereby corrected as shown below:

In Foreign Patent Document, "of 1910" should read 11/10.

In Abstract, line 14, after "by" insert --means of--.

Column 1, line 8, delete "method and".

Column 1, line 14, "hobbiests" should read --hobbyists--.

Column 1, line 29, "to" should read --of--.

In column 1, line 48, "flintlok" should read --flintlock--.

Column 1, lines 56-57, delete "a method and".

UNITED STATES PATENT AND TRADEMARK OFFICE

CERTIFICATE OF CORRECTION

PATENT NO. : 4,404,979

DATED : September 20, 1983

INVENTOR(S) : Larry R. Hobbs

It is certified that error appears in the above-identified patent and that said Letters Patent is hereby corrected as shown below:

Column 1, line 58, change "are" to --is--; and change "require" to --requires--.

In column 1, line 68, "of" should read --to--.

Column 2, line 3, delete "In accordance" and insert --To clean a rifle bore-- in its place; delete "method" and insert --apparatus--.

Column 2, line 17, delete "method and".

Column 2, line 21, delete "method and".

Column 2, line 23, "require" should read --requires--.

UNITED STATES PATENT AND TRADEMARK OFFICE

CERTIFICATE OF CORRECTION

PATENT NO. : 4,404,979

DATED : September 20, 1983

INVENTOR(S) : Larry R. Hobbs

It is certified that error appears in the above-identified patent and that said Letters Patent is hereby corrected as shown below:

In column 5, lines 3-4, "muzzle-loading" should read --muzzleloading--.

In Claim 2, column 6, line 25, after "drain" insert --tube--.

Signed and Sealed this

*Thirteenth* Day of *December 1983*

[SEAL]

*Attest:*

*Attesting Officer*

GERALD J. MOSSINGHOFF

*Commissioner of Patents and Trademarks*